US008141288B2

(12) United States Patent
Dodd et al.

(10) Patent No.: US 8,141,288 B2
(45) Date of Patent: Mar. 27, 2012

(54) RUGGED LOW LIGHT REFLECTIVITY ELECTRICAL CONTACT

(75) Inventors: James S. Dodd, Linden, VA (US); Jay Tilton, Leesburg, VA (US); Ben Feldman, Reston, VA (US)

(73) Assignee: Prototype Productions, Inc., Ashburn, VA (US)

( * ) Notice: Subject to any disclaimer, the term of this patent is extended or adjusted under 35 U.S.C. 154(b) by 66 days.

(21) Appl. No.: 12/791,460

(22) Filed: Jun. 1, 2010

(65) Prior Publication Data

US 2010/0279544 A1 Nov. 4, 2010

Related U.S. Application Data

(63) Continuation-in-part of application No. 12/689,430, filed on Jan. 19, 2010, now abandoned, and a continuation-in-part of application No. 12/689,436, filed on Jan. 19, 2010, and a continuation-in-part of application No. 12/689,437, filed on Jan. 19, 2010, and a continuation-in-part of application No. 12/689,438, filed on Jan. 19, 2010, and a continuation-in-part of application No. 12/689,440, filed on Jan. 19, 2010, and a continuation-in-part of application No. 12/689,498, filed on Jan. 19, 2010.

(60) Provisional application No. 61/183,250, filed on Jun. 2, 2009, provisional application No. 61/183,258, filed on Jun. 2, 2009, provisional application No. 61/145,248, filed on Jan. 16, 2009, provisional application No. 61/145,216, filed on Jan. 16, 2009, provisional application No. 61/145,232, filed on Jan. 16, 2009, provisional application No. 61/145,211, filed on Jan. 16, 2009, provisional application No. 61/145,222, filed on Jan. 16, 2009, provisional application No. 61/145,228, filed on Jan. 16, 2009.

(51) Int. Cl.
*F41A 19/00* (2006.01)

(52) U.S. Cl. ..... 42/84; 42/72; 42/124

(58) Field of Classification Search ..... 42/84, 72, 42/124

See application file for complete search history.

(56) References Cited

U.S. PATENT DOCUMENTS

| | | | | |
|---|---|---|---|---|
| 4,533,980 | A | 8/1985 | Hayes | |
| 5,033,219 | A * | 7/1991 | Johnson et al. | 42/115 |
| 5,142,806 | A | 9/1992 | Swan | |
| 5,360,949 | A * | 11/1994 | Duxbury | 174/250 |
| 5,826,363 | A | 10/1998 | Olson | |
| 6,237,271 | B1 | 5/2001 | Kaminski | |

(Continued)

OTHER PUBLICATIONS

In the US Patent and Trademark Office U.S. Appl. No. 12/689,430 Non-Final Office Action dated Feb. 17, 2011, 4 pages.

(Continued)

*Primary Examiner* — Michelle Clement
(74) *Attorney, Agent, or Firm* — Patton Boggs LLP

(57) ABSTRACT

The Low Reflectivity Contact has a low coefficient of light reflection, is rugged with respect to harsh ambient environmental conditions, provides a low resistance electrical connection, and is adapted for use in quick-connect applications. Light reflectivity of the contact is minimized by the use of a conductive mesh that is used to implement the electrical contact. The weave density and wire diameter of the conductive mesh maximizes the attenuation of reflected light in the visible spectrum, yet maintains high electrical conductivity and a lack of sensitivity to contamination via the choice of materials used to implement the Low Reflectivity Contact.

17 Claims, 13 Drawing Sheets

U.S. PATENT DOCUMENTS

| | | | | |
|---|---|---|---|---|
| 6,925,744 | B2 * | 8/2005 | Kincel | 42/71.01 |
| 7,144,830 | B2 * | 12/2006 | Hill et al. | 442/205 |
| 7,243,454 | B1 * | 7/2007 | Cahill | 42/72 |
| 7,421,818 | B2 | 9/2008 | Houde-Walter | |
| 7,464,495 | B2 * | 12/2008 | Cahill | 42/72 |
| 7,525,203 | B1 | 4/2009 | Racho | |
| 7,562,483 | B2 * | 7/2009 | Hines | 42/90 |
| 7,584,569 | B2 | 9/2009 | Kallio et al. | |
| 7,627,975 | B1 | 12/2009 | Hines | |
| 7,640,690 | B2 * | 1/2010 | Hines | 42/75.03 |
| 7,676,975 | B2 * | 3/2010 | Phillips et al. | 42/72 |
| 7,712,241 | B2 | 5/2010 | Teetzel et al. | |
| 7,818,910 | B2 * | 10/2010 | Young | 42/71.01 |
| 7,841,120 | B2 | 11/2010 | Teetzel et al. | |
| 7,866,083 | B2 | 1/2011 | Teetzel | |
| 7,975,419 | B2 * | 7/2011 | Darian | 42/84 |
| 8,001,715 | B2 * | 8/2011 | Stokes | 42/146 |
| 2005/0241206 | A1 | 11/2005 | Teetzel et al. | |
| 2008/0040965 | A1 | 2/2008 | Solinsky et al. | |
| 2008/0170838 | A1 * | 7/2008 | Teetzel et al. | 386/118 |
| 2008/0190002 | A1 * | 8/2008 | Hines | 42/1.06 |
| 2009/0044439 | A1 * | 2/2009 | Phillips et al. | 42/72 |
| 2009/0108589 | A1 * | 4/2009 | Racho | 290/1 R |
| 2009/0255160 | A1 * | 10/2009 | Summers | 42/70.01 |
| 2010/0031552 | A1 | 2/2010 | Houde-Walter | |
| 2010/0083553 | A1 | 4/2010 | Montgomery | |
| 2010/0192443 | A1 * | 8/2010 | Cabahug et al. | 42/71.02 |
| 2010/0192444 | A1 * | 8/2010 | Cabahug et al. | 42/71.02 |
| 2010/0192446 | A1 | 8/2010 | Darian | |
| 2010/0192448 | A1 | 8/2010 | Darian | |
| 2010/0218410 | A1 * | 9/2010 | Cabahug et al. | 42/71.01 |
| 2010/0242332 | A1 | 9/2010 | Teetzel et al. | |
| 2011/0000120 | A1 | 1/2011 | Thompson | |
| 2011/0010979 | A1 | 1/2011 | Houde-Walter | |
| 2011/0162251 | A1 * | 7/2011 | Houde-Walter | 42/146 |
| 2011/0173865 | A1 * | 7/2011 | Compton et al. | 42/84 |

OTHER PUBLICATIONS

Third Party Submission by Michael B. Brooks dated May 12, 2011.

* cited by examiner

POWER CONNECTOR ASSEMBLY SECTION

RUGGED LOW LIGHT REFLECTIVITY ELECTRICAL CONTACT

CROSS-REFERENCE TO RELATED APPLICATIONS

This application claims the benefit of U.S. Provisional Patent Application Ser. No. 61/183,250 filed on Jun. 2, 2009 entitled "Non-Reflective, Conductive Mesh, Environmentally Robust Electrical Contacts." This application is also a continuation-in-part of U.S. patent application Ser. No. 12/689,430 filed on Jan. 19, 2010 entitled "Rifle Accessory Rail, Communication And Power Transfer System", which claims the benefit of U.S. Provisional Patent Application Ser. No. 61/145,248 filed on Jan. 16, 2009; U.S. patent application Ser. No. 12/689,436 filed on Jan. 19, 2010 entitled "Accessory Mount For Rifle Accessory Rail Communication And Power Transfer System, Accessory Attachment", which claims the benefit of U.S. Provisional Patent Application Ser. No. 61/145,216 filed on Jan. 16, 2009; U.S. patent application Ser. No. 12/689,437 filed on Jan. 19, 2010 entitled "Rifle Accessory Rail Communication And Power Transfer System—Communication", which claims the benefit of U.S. Provisional Patent Application Ser. No. 61/145,232 filed on Jan. 16, 2009; U.S. patent application Ser. No. 12/689,438 filed on Jan. 19, 2010 entitled "Rifle Accessory Rail Communication And Power Transfer System—Battery Pack", which claims the benefit of U.S. Provisional Patent Application Ser. No. 61/145,211 filed on Jan. 16, 2009; U.S. patent application Ser. No. 12/689,440 filed on Jan. 19, 2010 entitled "Rifle Accessory Rail Communication And Power Transfer System—Rail Contacts", which claims the benefit of U.S. Provisional Patent Application Ser. No. 61/145,222 filed on Jan. 16, 2009; and U.S. patent application Ser. No. 12/689,439 filed on Jan. 19, 2010 entitled "Rifle Accessory Rail Communication And Power Transfer System—Power Distribution", which claims the benefit of U.S. Provisional Patent Application Ser. No. 61/145,228 filed on Jan. 16, 2009. The foregoing applications are hereby incorporated by reference to the same extent as though fully disclosed herein.

FIELD OF THE INVENTION

The invention relates generally to the field of electrical contacts and, more particularly, to electrical contacts which have a low light reflectivity characteristic, are rugged with respect to harsh ambient environmental conditions, and provide a low resistance electrical connection.

BACKGROUND OF THE INVENTION

It is a problem to manufacture electrical contacts that provide low resistivity, operate in a reliable manner in an environmentally hostile environment, are inexpensive, are long lived, and yet also have a low light reflectivity characteristic. The typical adverse natural environment includes, but is not limited to, corrosion, chemical contamination, extreme temperatures, humidity, rain, dirt, ice, and abrasion.

There are two modes of electrically interconnecting two or more circuit elements together. One mode of electrical interconnection is to hardwire the circuit elements together, which renders the resultant apparatus a unitary structure. The second mode of electrical interconnection is to use one or more electrical contacts to interconnect the circuit elements, thereby enabling the circuit elements to be removably attached to each other and/or to a power source. The electrical contacts are either mounted on mating surfaces of two elements, coming into contact when the two elements are juxtaposed to each other and mechanically forced together, or mounted in connectors, which are electrically tethered to the respective elements via cables, and joined together via locking connector shells which house the respective set of mating electrical contacts and protect the respective sets of contacts from the ambient environment.

The use of electrical contacts mounted on mating surfaces of two elements is optimal for quick connect applications, but these contacts are susceptible to contamination, which degrades performance. The exposed contacts, therefore, must be manufactured from a material that provides low resistivity (such as gold) even when exposed to the hostile ambient environment. However, contacts of this type also create highly reflective surfaces which represent a unique problem in the application of these contacts to military weapons, where camouflage is a paramount concern.

To protect electrical contacts from hostile ambient environmental conditions, such as outdoor applications, the electrical contacts typically are housed in a weatherproof housing, such as a connector shell or a weatherproof sealed box. However, the tethering electrical cable and the connector shell are significantly more expensive than the use of electrical contacts mounted on mating surfaces of two elements, although they provide greater protection from the environment, but are also less convenient for quick connect applications.

Thus, there is presently no electrical contact that can be used in a quick connect application which provides low resistivity, operates in a reliable manner in a hostile ambient environment, is inexpensive, is long lived, and yet also has a low light reflectivity characteristic.

BRIEF SUMMARY OF THE INVENTION

The above-described problems are solved and a technical advance achieved by the present Rugged Low Light Reflectivity Electrical Contact (termed "Low Reflectivity Contact" herein) which has a low coefficient of light reflection, is rugged with respect to harsh ambient environmental conditions, provides a low resistance electrical connection, and is adapted for use in quick connect applications. One application for surface mount contacts is the use in military weapons. A firearm used in military applications may have a plurality of accessories that can be attached to the weapon, with each accessory having a need for electric power. In order to reduce the weight of these power-consuming accessories, as well as the proliferation of batteries used to power these power-consuming accessories, a common power source is used to power whatever power-consuming accessory is attached to the weapon. The power transfer between the power source and the power-consuming accessories should be via a permanent power distribution fixture mounted on the weapon, yet susceptible to quick connect mounting and dismounting of the power-consuming accessory, and absent the use of connectors with their tethering cables, which are susceptible to entanglement.

Light reflectivity of the electrical contact is minimized by the use of a conductive mesh grid, which is attached to an underlying conductive surface. The conductive mesh grid (also termed "mesh grid" herein) comprises a substantially planar structure, typically a matrix of interconnected wires with apertures formed between the intersecting wires, and is used to form the outer surface of the electrical contact. The weave density, weave geometry, and wire diameter of the conductive mesh grid maximizes the attenuation of reflected light in the visible spectrum, yet maintains high electrical conductivity and a lack of sensitivity to contamination via the choice of materials used to implement the Low Reflectivity Contact.

The Low Reflectivity Contact is designed for use in an unprotected manner where the electrical contacts are exposed to harsh ambient environmental conditions. The Low Reflectivity Contact as disclosed herein is part of an overall Weapons Accessory Power System which provides the following benefits:

Use of a single compact power source,

Significant reduction in the weight of the accessory/power source system,

Compatibility with the existing Picatinny Rail for mounting accessories,

Performance reliability, and

Inexpensive to manufacture.

The primary components of this Weapons Accessory Power System, which is used as an application example to illustrate the benefits of the present Low Reflectivity Contact, are:

Battery Pack,

Power Connector,

Handguard,

Powered Rail, and

Powered Accessory Mounting.

The following description provides a brief disclosure of these elements of the Weapons Accessory Power System in sufficient detail to understand the teachings and benefits of the Low Reflectivity Contact. It is expected that many other applications of the Low Reflectivity Contact can be envisioned by one of ordinary skill in the art, and the Weapons Accessory Power System is simply one application of the Low Reflectivity Contact, which is delimited by the appended claims.

BRIEF DESCRIPTION OF THE DRAWINGS

FIGS. 6A and 6B are perspective views of two implementations of the Powered Rail, while

DETAILED DESCRIPTION OF THE PREFERRED EMBODIMENT

Definitions

Contact—One-half of a Contact Pair consisting of an electrically conductive surface which is electrically connected to a power source or power-consuming device.

Contact Pair—A set of two Contacts which, when brought together in mechanical contact, complete an electrical circuit enabling the transfer of electrical power and/or electrical signals therebetween.

Visible Spectrum—The visible spectrum is the portion of the electromagnetic spectrum that is visible to (can be detected by) the human eye. Electromagnetic radiation in this range of wavelengths is called "visible light" or simply "light". A typical human eye responds to wavelengths from about 390 nm to 750 nm. In terms of frequency, this corresponds to a band in the vicinity of 400 THz to 790 THz.

Electrical Resistivity—Electrical Resistivity is a measure of how strongly a material opposes the flow of electric current. A low resistivity indicates a material that readily allows the movement of electrical charge.

Electrical Conductivity—Electrical Conductivity (the inverse of Electrical Resistivity) is a measure of how strongly a material supports the flow of electric current. A high conductivity indicates a material that readily allows the movement of electrical charge.

Picatinny Rail

It is well known to those skilled in the art that rapid fire firearms, utilized particularly in military operations, are characterized by the heating of the barrel of the weapon to relatively high temperatures. At such temperatures, the barrel cannot be safely held by the person firing the weapon. Consequently, a variety of handguards have been developed to shroud the barrel of such rapid fire weapons to enable the person firing the weapon to grip the forward portion of the weapon while mitigating the possibility of burning the hand of the person firing the weapon, yet also providing adequate cooling for the barrel of the weapon.

Figure 1A:
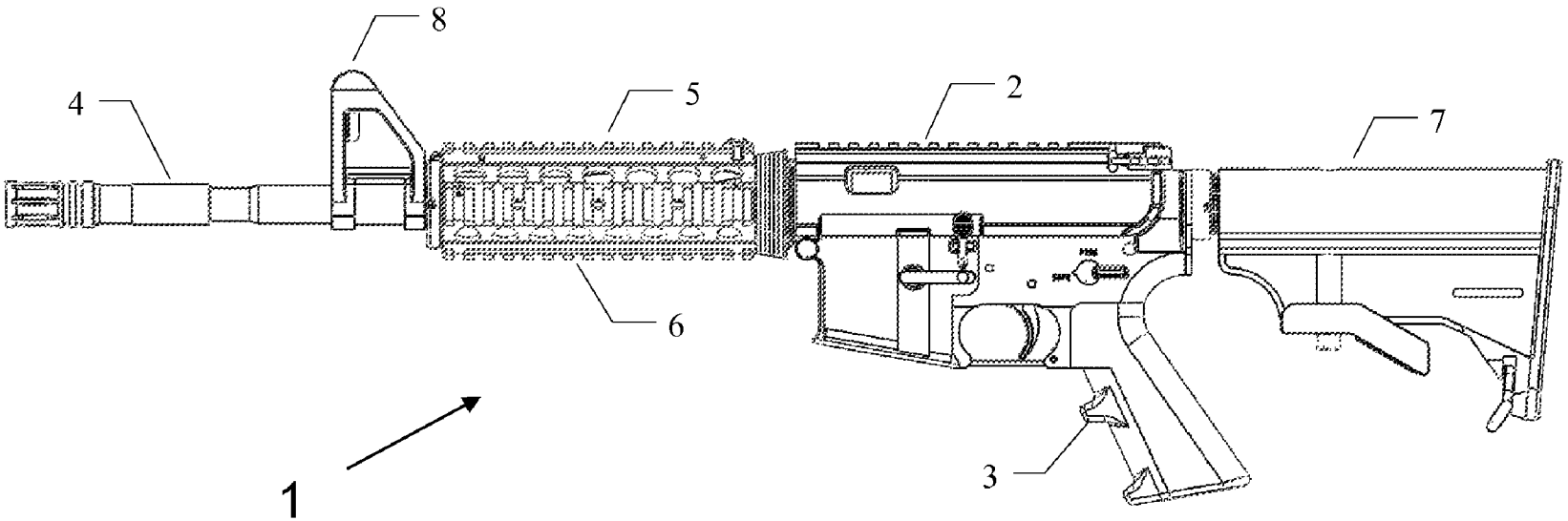
FIGURE 1A PRIOR ART
FIGS. 1A-1C are illustrations of the prior art Picatinny Rail mounted on a military style weapon, which is used to mount accessories to the weapon as is well known in the art.
Figure 1B:
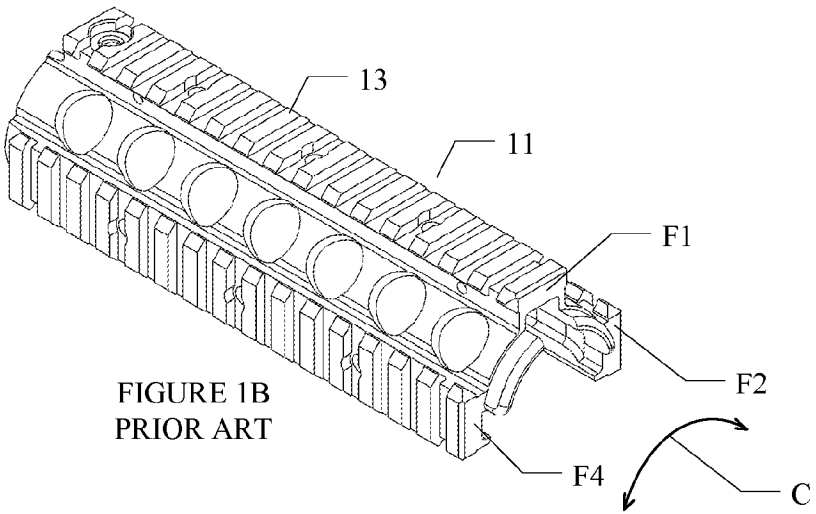
FIGURE 1B PRIOR ART
Figure 1C:
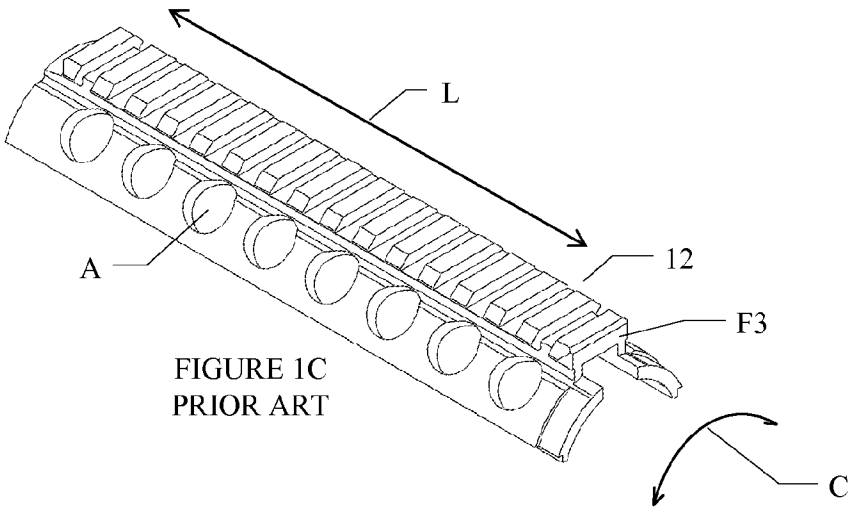
FIGURE 1C PRIOR ART

FIGS. 1A-1C are illustrations of the prior art Picatinny Rail mounted on a military style weapon 1, which is used to mount accessories to the weapon as is well known in the art. The weapon 1 contains the standard components, such as receiver 2, grip 3, barrel 4, handguard 5, 6, butt stock 7, and front sight 8. The Picatinny Rail or MIL-STD-1913 rail is a bracket used on some firearms to provide a standardized accessory mounting platform. Its name comes from the Picatinny Arsenal in New Jersey, USA where it was originally tested and was used to distinguish it from other rail standards at the time. The Picatinny Rail comprises a series of ridges with a T-shaped cross-section interspersed with flat "spacing slots". Scopes are mounted either by sliding them on from one end of the Picatinny Rail or the other end of the Picatinny Rail by means of a "rail-grabber", which is clamped to the Picatinny Rail with bolts, thumbscrews, or levers, or onto the slots between the raised sections.

With particular reference to FIGS. 1A-1C, the Picatinny Rail handguard 5, 6 includes a top semi-cylindrical (C) part 11 and a bottom semi-cylindrical (C) part 12. The top semi-cylindrical part 11 is defined by a back end having a back end ledge that engages with a slip ring and a front end having a front end ledge that engages with the receptor cap to retain the part 11 about the barrel 4. Similarly, the bottom part 12 is defined by a back end having a back end ledge that engages with the slip ring and a front end having a front end ledge that engages with the receptor cap to retain the part 12 about the barrel 4. An accessory adapter rail 13 extends longitudinally and upwardly from the top semi-cylindrical part 11. The handguard 5, 6 may also include accessory adapter side rails and accessory adapter bottom rails. Thus, the Picatinny Rail is formed of a multi-faceted (F1-F4) structure, on each facet of which accessories can be mounted. Apertures A are provided along the length dimension L of the Picatinny Rail to enable the barrel 4 of the weapon 1 to be cooled by air circulation from the ambient environment.

The Picatinny Rail was originally designed for use with scopes. However, once established, the use of the Picatinny Rail was expanded to other accessories, such as tactical lights, laser aiming modules, night vision devices, reflex sights, fore grips, bipods, and bayonets. Because the Picatinny Rail was originally designed and used for telescopic sights, the rails were first used only on the receivers of larger caliber rifles. However, their use has extended to the point that Picatinny Rails and accessories have replaced iron sights in the design of many firearms, and they are also incorporated into the undersides of semi-automatic pistol frames and even on grips.

In order to provide a stable platform, the rail should not flex as the barrel heats and cools; this is the purpose of the spacing slots: they give the rail considerable room to expand and contract lengthwise without distorting its shape. The Picatinny locking slot width is 0.206 in (5.23 mm). The spacing of slot centers is 0.394 in (10.01 mm) and the slot depth is 0.118 in (3.00 mm).

Powering the multitude of accessories used on weapons equipped with the Picatinny Rail has been accomplished by equipping each accessory with its own set of batteries. A significant problem with this paradigm is that multiple types of batteries are used for accessories, thereby requiring an extensive inventory of replacements. In addition, the batteries, especially on high power accessories, add significant weight to the barrel end of the weapon, adding strain to the user of the weapon to hold the barrel "on target" in an "off-hand manner" without support for the barrel.

Reticle Illumination

One example of an accessory for a weapon is a scope which includes a reticle which can be illuminated for use in low light or daytime conditions. The reticle is a grid of fine lines in the focus of the scope, used for determining the position of the target. With any illuminated low light reticle, it is essential that its brightness can be adjusted. A reticle that is too bright causes glare in the operator's eye, interfering with his ability to see in low light conditions. This is because the pupil of the human eye closes quickly upon receiving any source of light. Most illuminated reticles provide adjustable brightness settings to adjust the reticle precisely to the ambient light. Illumination is usually provided by a battery powered LED, though other electric light sources can be used. The light is projected forward through the scope, and reflects off the back surface of the reticle. Red is the most common color used, as it least impedes the shooter's night vision. This illumination method can be used to provide both daytime and low light conditions reticle illumination.

Other examples of powered accessories include, but are not limited to: tactical lights, laser aiming modules, and night vision devices.

Weapon Equipped With Weapons Accessory Power System

Figure 2A:
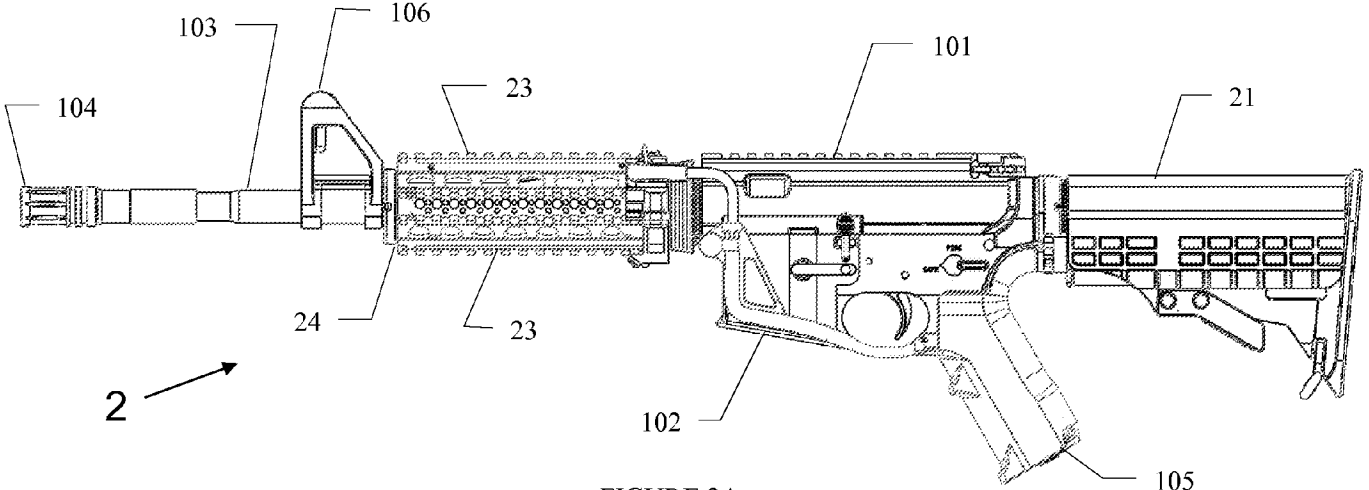
FIGS. 2A and 2B are illustrations of the system architecture of a military style weapon equipped with a Weapons Accessory Power System.
Figure 2B:
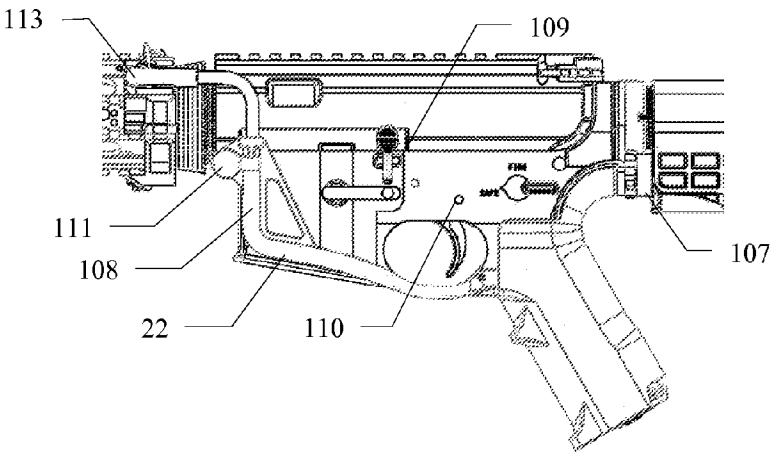

FIGS. 2A and 2B are illustrations of the system architecture of a military style weapon 2 equipped with a Weapons Accessory Power System. The primary components of the basic Weapons Accessory Power System as noted above are:

Battery Pack 21;
Power Connector 22;
Handguard 23;
Powered Rail 24; and
Powered Accessory Mounting 25 (shown in FIG. 8A).

The existing military-style weapon 2 includes in well-known fashion an upper receiver 101, lower receiver 102, barrel 103, muzzle 104, grip 105, and front sight 106. While a military-style weapon is described herein, the teachings of this application are equally applicable to other firearms, such as handguns, fixed mount machine guns, as well as non-weapons based systems. The Weapons Accessory Power System is added to this standard military-style weapon 2 as described herein.

The Handguard 23 performs the barrel shielding function as in the Picatinny Rail noted above, but has been modified to include channels and slots to accommodate the Powered Rail 24 and electrical interconnection of the Powered Accessory Mounting 25 to the Powered Rail 24, as described below. These components are described below in sufficient detail to provide the proper context for an understanding of the architecture and operation of the present Low Reflectivity Contact.

Handguard

As noted above, the Handguard 23 was developed to shroud the barrel 103 of a rapid fire weapon 2 to enable the person firing the weapon 2 to grip the forward portion of the weapon 2 while mitigating the possibility of burning the hand of the person firing the weapon 2, yet also providing adequate cooling for the barrel 103 of the weapon. Handguards find application in rifles, carbines, and fixed mount weapons, such as machine guns. However, the Weapons Accessory Power System can also be used in modified form for handguns, as an accessory mounting platform and accessory power source.

Figure 5A:
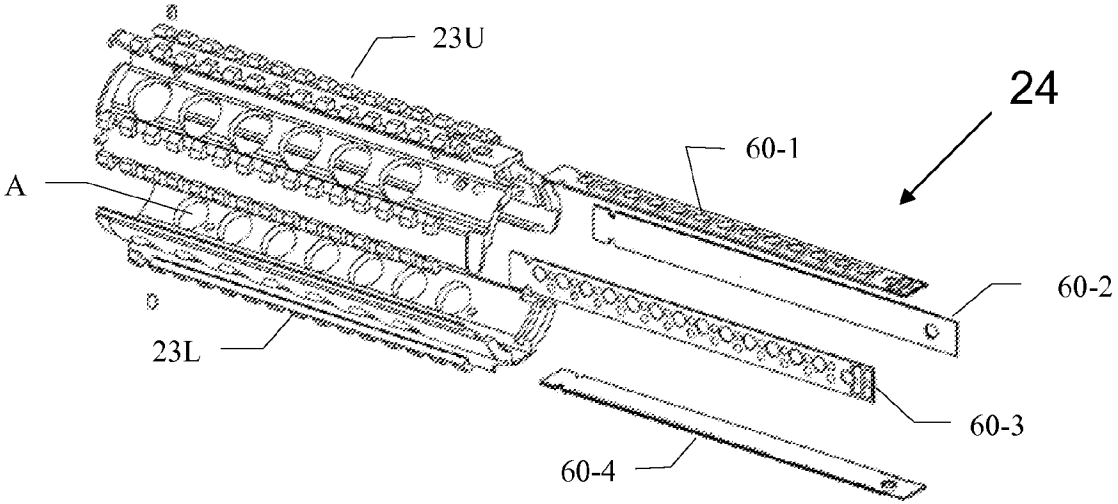
FIGS. 5A-5C are illustrations of the Handguard assembly, including the Powered Rail, of the Weapons Accessory Power System.
Figure 5B:
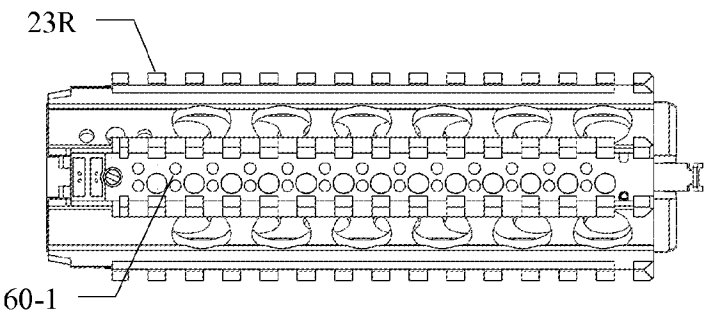
Figure 5C:
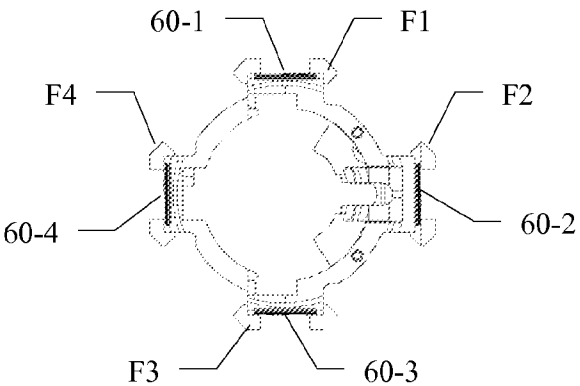

FIGS. 5A-5C are perspective exploded, side view and end view illustrations, respectively, of the Handguard 23 assembly, including the Powered Rail 24, of the Weapons Accessory Power System. Handguard 23 can be viewed as an adaptation of the existing non-powered Picatinny Rail which involves milling slots along the length of the mechanical accessory attachment points 23R in the upper Handguard section (23U) and the lower Handguard section (23L) in order to install one or more power distribution Printed Circuit Boards 60-1 to 60-4, with FIG. 5C showing an end view of the slots formed in the various facets F1-F4 of the Handguard 23. As with the Picatinny Rail, Apertures A are provided along the length dimension L of the Handguard 23 to enable the barrel 103 of the weapon 2 to be cooled by air circulation from the ambient environment.

One or more of the Powered Rail subassemblies 60-1 to 60-4 can be inserted into the respective slots formed on the corresponding facets F1-F4 of the Handguard 23 thereby to enable power-consuming accessories to be attached to the Handguard 23 of the weapon 2 on any facet F1-F4 of the Handguard 23 and to be powered by the corresponding Powered Rail 60-1 to 60-4 installed on that facet.

Battery Pack

Figure 3A:
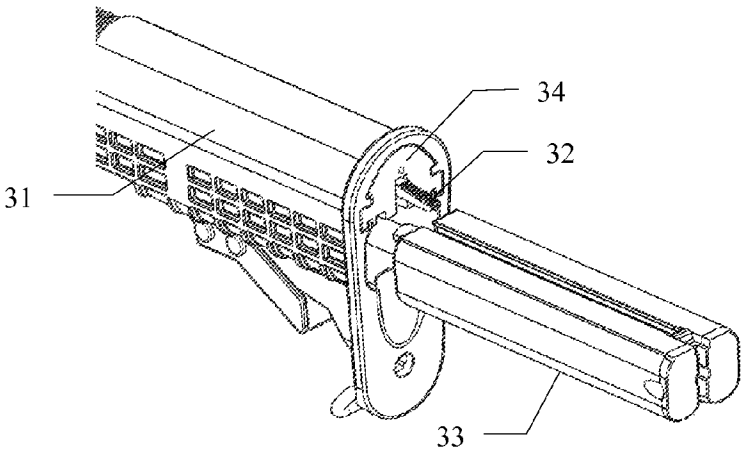
FIGS. 3A and 3B are illustrations of a typical butt stock battery pack of the Weapons Accessory Power System.
Figure 3B:
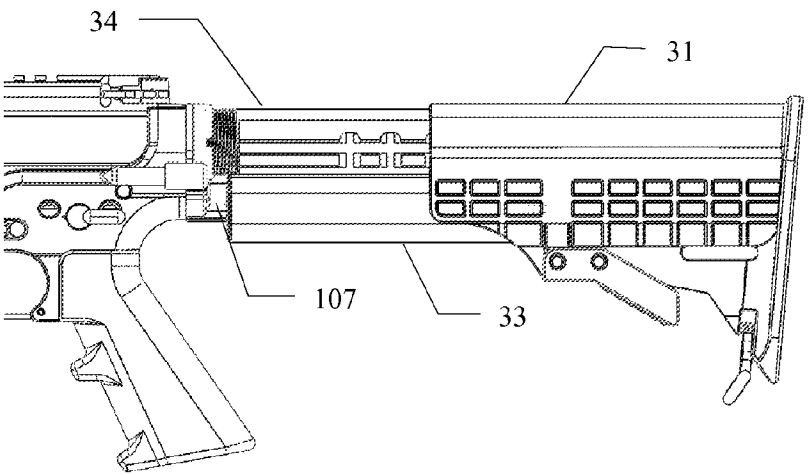
Figure 4A:
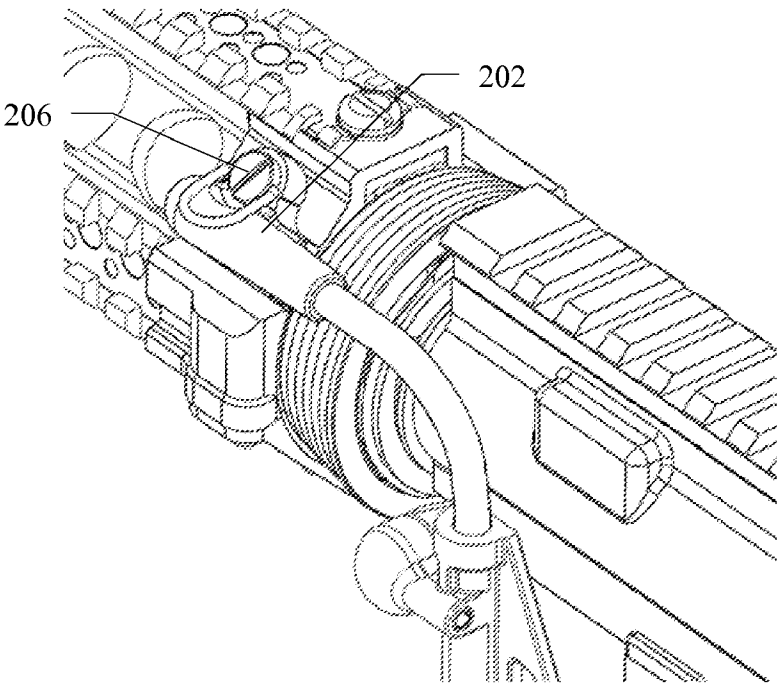
FIGS. 4A-4C are illustrations of the Power Connector which interconnects the Battery Pack to the Powered Rail in the Weapons Accessory Power System.
Figure 4B:
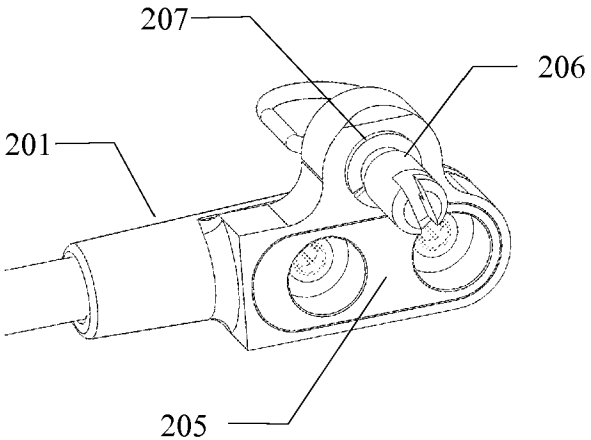
Figure 4C:
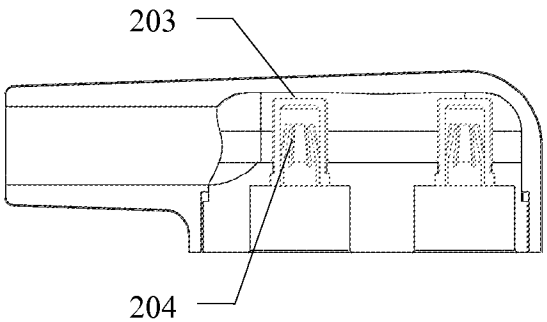

The Battery Pack 21 can be implemented in a number of assemblies and mounted on various portions of the weapon as described in the above-noted U.S. patent application Ser. No. 12/689,438 filed on Jan. 19, 2010 entitled "Rifle Accessory Rail Communication And Power Transfer System—Battery Pack". For the purpose of this description, FIGS. 3A and 3B are illustrations of a typical butt stock Battery Pack 21 of the Weapons Accessory Power System. For example, a butt stock/recoil tube battery pack assembly includes an adjustable butt stock 31, a cam latch 32, and a removable battery rack 33. The butt stock 31 adds a compartment to the under-side of the existing buffer tube assembly 34 which allows the battery rack 33 to be installed and withdrawn for removal through the rear of the rifle. The battery rack 33 mounts on the buffer tube assembly 34 independent of the butt stock 31 which telescopes along the rifle. The butt stock 31 is adjustable and can be extended in various multiple intermediate positions to provide an adjustable length of the firearm, as is well known in the art.

Power Connector

The Power Connector 22 is shown in FIGS. 2A, 2B, and 4A-4C as a one-piece housing 201 and ruggedized power rail connector 202 where sealing integrity is maintained during exposure to adverse environmental conditions. The power rail connector 202 consists of a metallic body, contact pin receptacle 203, with a press fit multi-finger spring contact 204 assembled into a machined shell body. The multi-finger spring contact 204 provides compliance to variations in the mating pin to ensure continuous current carrying capacity of the connection. The shell body of the receptacle pin 203 includes a solder tail portion for soldering cable wires. The bottom panel insulator mounts the pin receptacles 205 with the bottom part and fitted over the connector metallic body 203 and is sealed with a sealing compound. A fastener 206 and retaining ring 207 are used to secure the connector assembly into the rail pin contacts.

An electric wire is routed from the Battery Pack 21 in the butt stock 31 to the Powered Rail 24. The external wiring is housed inside a durable and impact resistant polymer shroud 106 that conforms to the lower receiver 102. The shroud is securely retained by a quick connect/disconnect pivot and takedown pin 111 as well as the bolt release roll pin 109 in the trigger/hammer pins 110. The shrouded power cable 106 runs from the battery power connector 107 at the butt stock 31 to the Power Rail connector 202. This design provides an easy access for replacing or repairing the cable assembly and eliminates snag hazards or interferences with the rifle operation and requires no modifications to the rifle lower receiver 102 housing.

Powered Rail

The Powered Rail 24 is used to electrically interconnect a power source (Battery Pack 21) with the various accessories mounted on the Handguard 23, such that the Handguard 23 provides the mechanical support for the accessory and the Powered Rail 24 provides the electrical interconnection. The Powered Rail 24 is attached to and coextensive with the Handguard 23, such that the mounting of an accessory on the Handguard 23 also engages the Powered Rail 24 so that mechanical and electrical interconnection is simultaneously achieved.

Figure 6A:
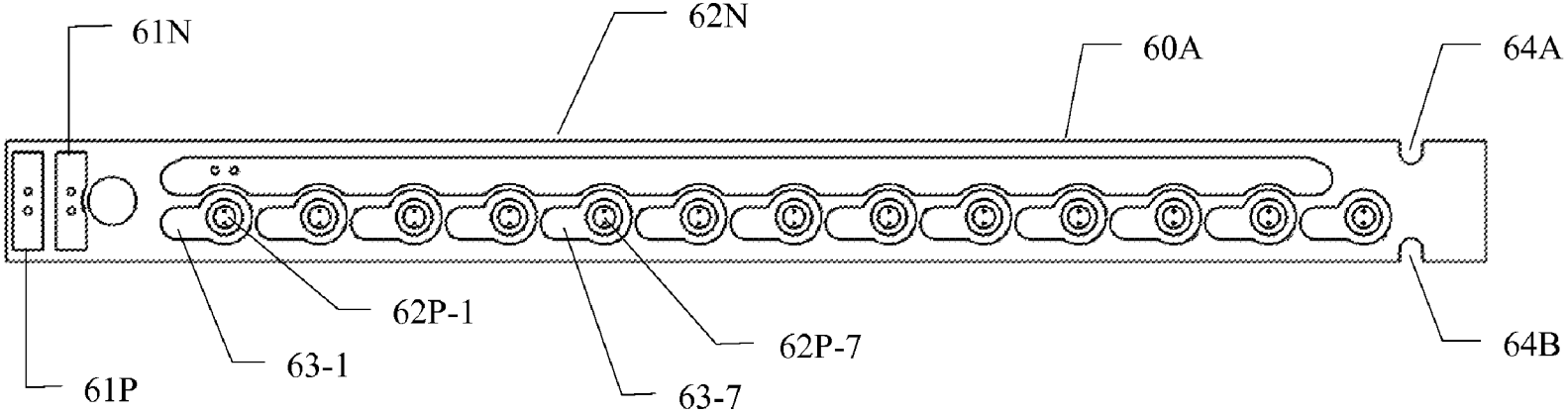
Figure 6B:
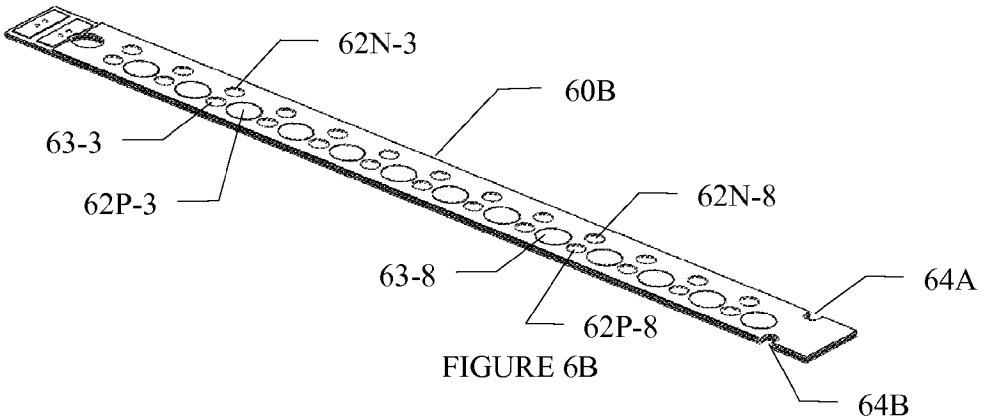
Figure 6C:
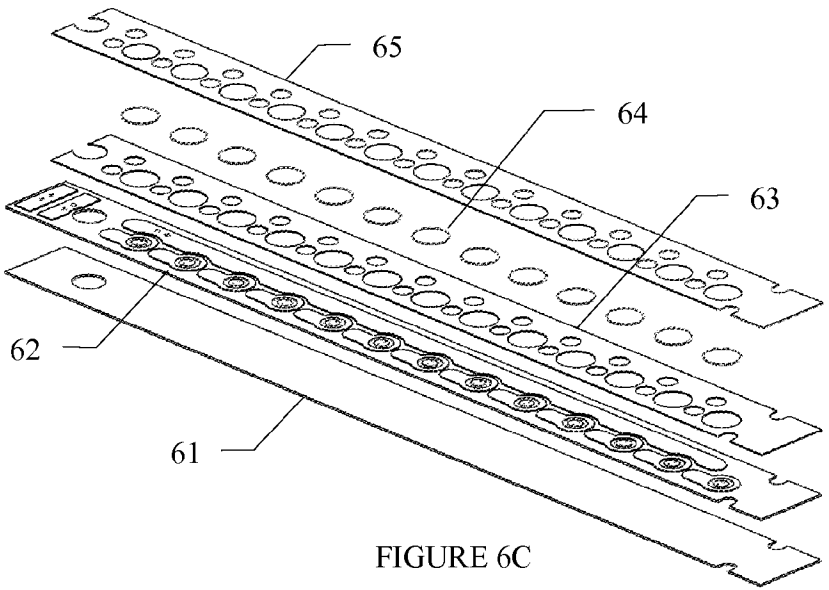
FIG. 6C is an exploded perspective view of the Powered Rail.
Figure 7B:
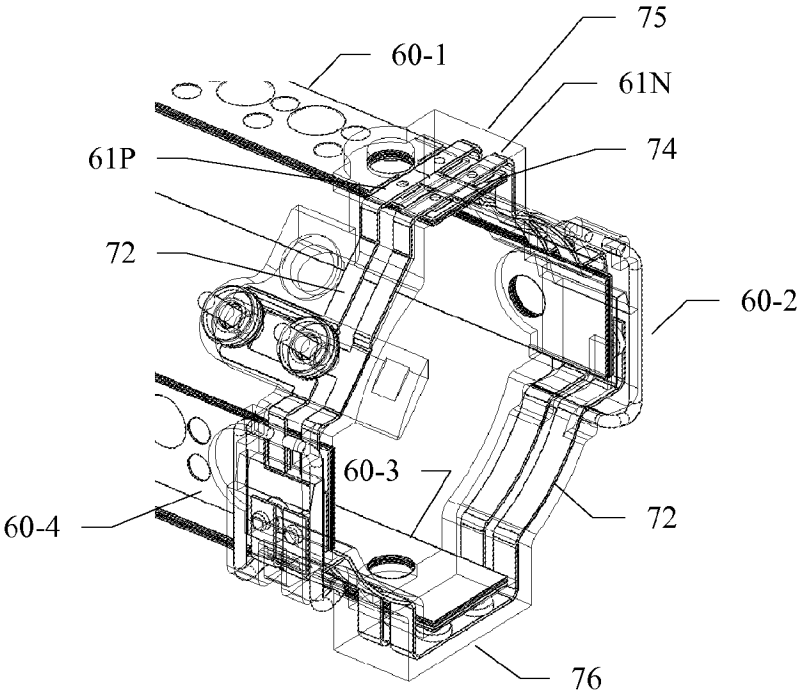
FIGS. 7A and 7B illustrate the details of the Powered Rail electrical interconnection.
Figure 7A:
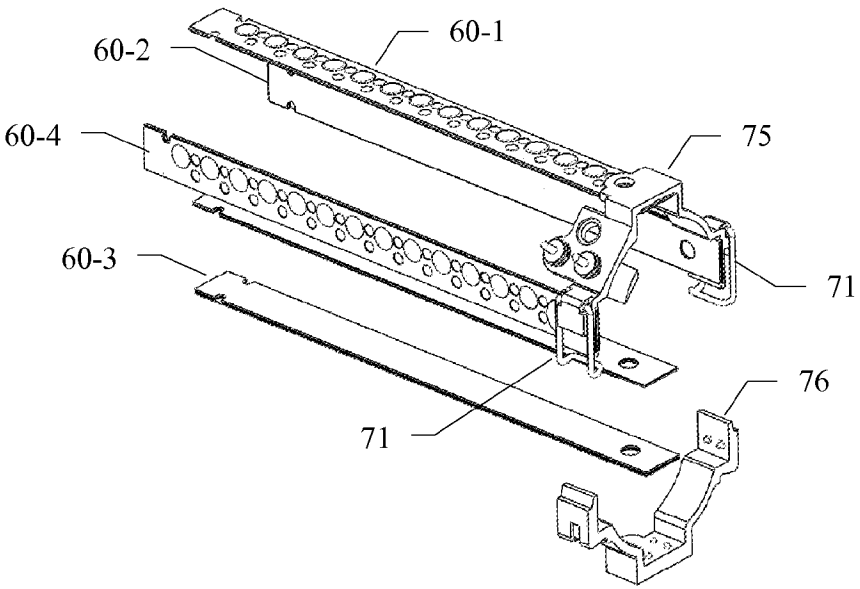
Figure 8A:
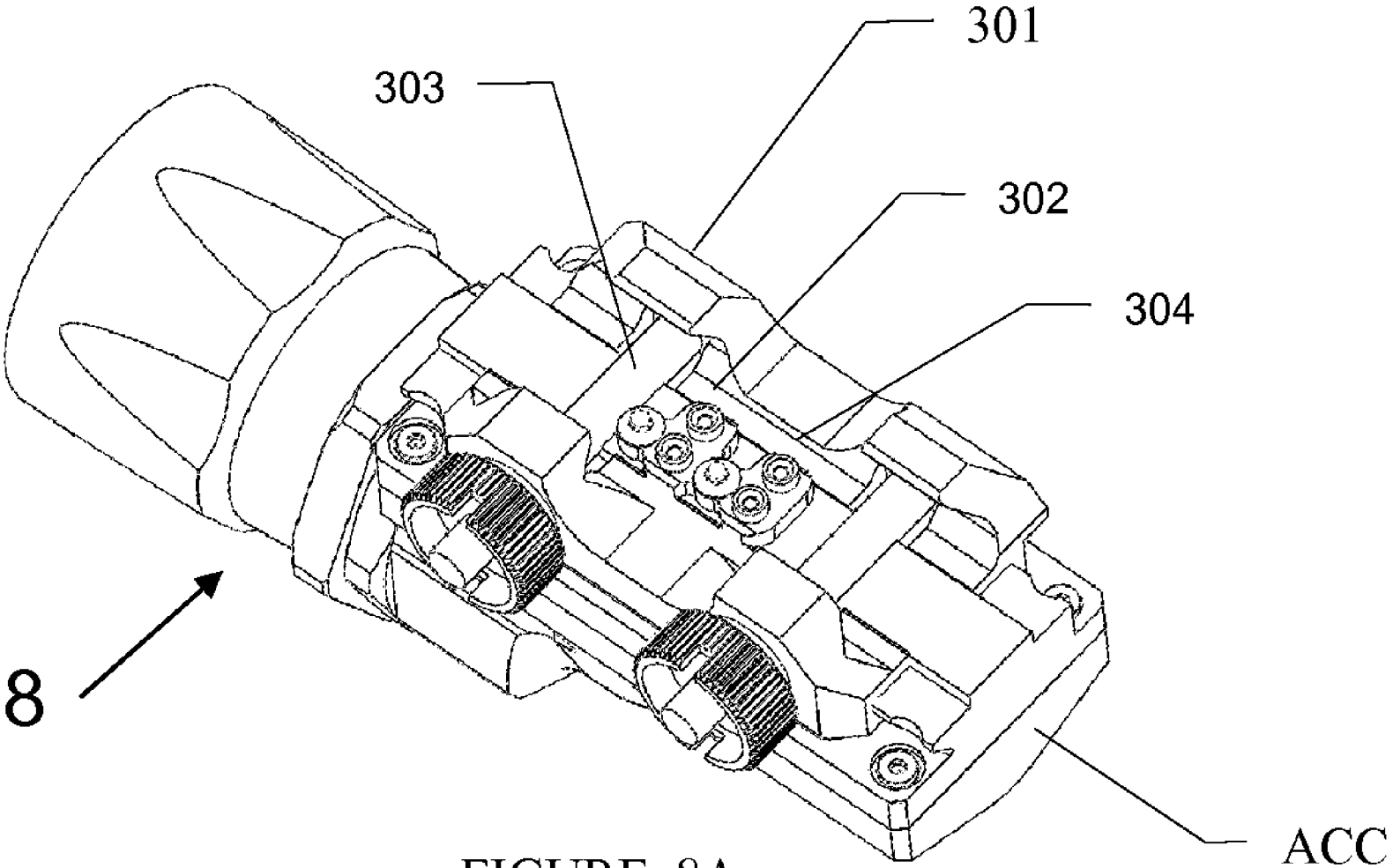
FIGS. 8A-8C are illustrations of the typical mechanical interconnection and electrical interconnection of an accessory to the Handguard and Powered Rail.
Figure 8C:
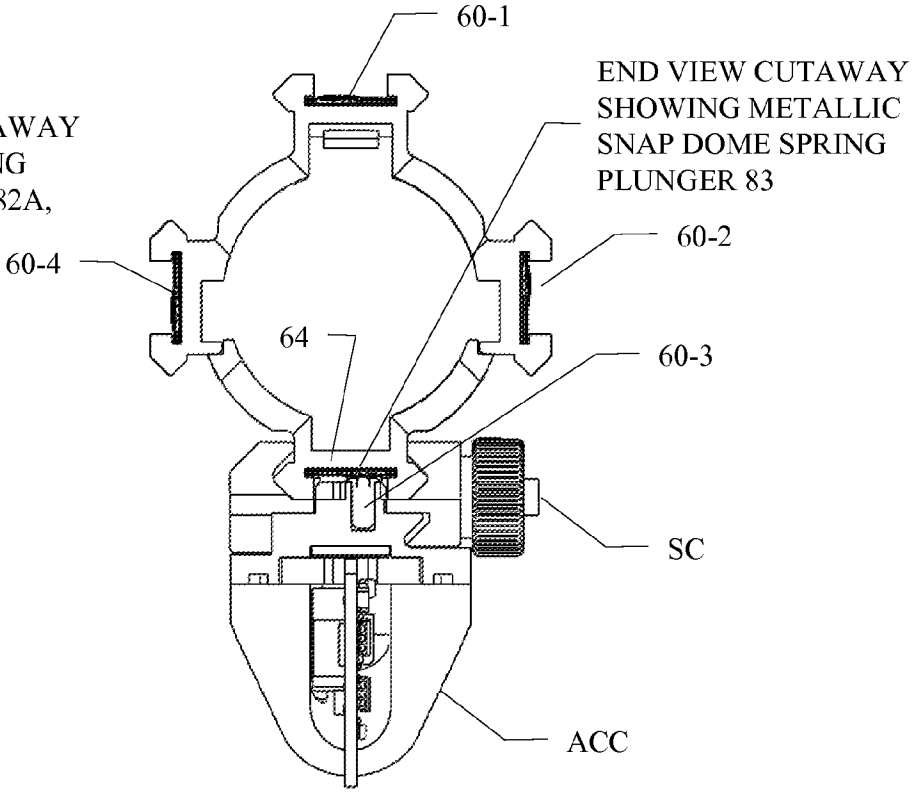
Figure 8B:
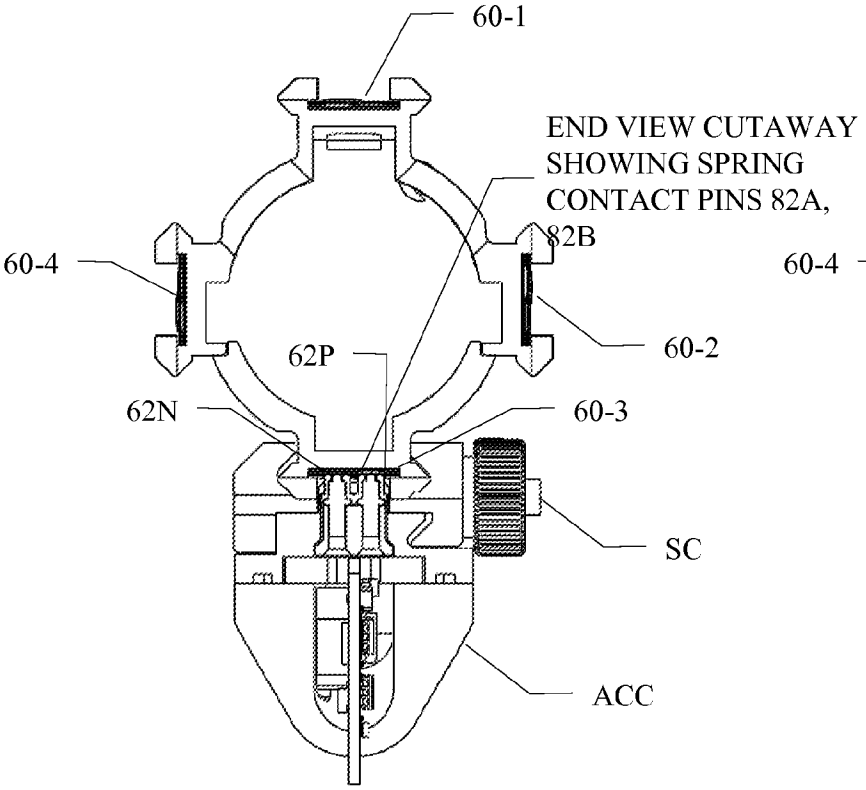

FIGS. 6A and 6B are top views of two versions of the Powered Rail 24 which FIG. 6C is an exploded view of the Powered Rail 24; FIGS. 7A and 7B illustrate the details of the Powered Rail 24 electrical interconnection; and FIGS. 8A-8C are illustrations of the typical mechanical interconnection and electrical interconnection of an accessory to the Handguard 23 and Powered Rail 24.

As noted above, the Powered Rail 24 comprises one or more Printed Circuit Boards (60-1 to 60-4) which are mounted on the Handguard 23 to carry power to accessories which are mounted on the Handguard 23 at various locations. The Printed Circuit Boards (60-1 to 60-4) are soldered to electrically conductive busses 72 via terminal pads 74. In addition, a conductive pin connector 73 includes a terminal portion at one end which is pressed into the mating hole in the interconnect electrical bus 72. Retaining clips 71 are manufactured from resilient metallic spring material, which are anchored on the upper rail connector 75 and a clamp hook feature of the retaining clip is used to securely hold the lower rail connector 76. FIG. 7B illustrates the spring pin contacts 71 and electrical buses 72 typically encapsulated in an insulative protective coating. The connector is removable and can be easily mounted through the retaining clips 71 which provide positive retention and a means of securing the connector halves. Mated connector pairs have tab features which captivate the clips.

FIGS. 6A and 6B illustrate the architecture of the Printed Circuit Board where remote power is applied via the positive connector contact 61P and the negative connector contact 61N. The power is routed by the electrical traces on the Printed Circuit Board 60A. The positive current from positive connector contact 61P is routed to the center of the Printed Circuit Board contacts (for example, 62P-7), while the negative current from the negative connector contact 61N is routed to the negative buss 62N or negative bus contact pads (for example, 62N-3). The example shown in these figures provided thirteen positions where a power-consuming accessory can be attached and contact the power contacts of the Powered Rail 24. In particular, on both FIGS. 6A and 6B, there are thirteen positive contacts 62P-1 to 62P-13 (only several of which are numbered on the figures to avoid clutter). In FIG. 6A, a continuous negative buss 62N is provided as the other power source connection. In FIG. 6B, the negative power source connections are provided by thirteen individual negative buss contact pads 62N-1 to 62N-13 (only several of which are numbered on the figures to avoid clutter). On the printed circuit board 60A, there are points of attachment, typically comprising notches 64A and 64B, which are used to secure the printed circuit board in place in the corresponding slot of the Handguard 23 via a pin clip arrangement.

The positive 62P and negative 62P contacts can be continuously powered, especially in the case where only one set of contacts is provided, or can be switch activated by metallic snap dome switches 64 which are placed over positive common 62P and are in electrical contact with the accessory positive switched contact 63. The metallic snap dome switch has a pair of conductive contacts which are normally in the open mode; when the cover of the metallic snap dome switch is depressed via a projection on the exterior surface of the power-consuming accessory which is mounted on the Handguard 23 juxtaposed to the metallic snap dome switch, these contacts mate and provide an electrical connection between positive common 62P and the surrounding accessory positive switched contact 63. The metallic snap dome switch is a well-known component and consists of a curved metallic dome that spans two conductors (positive common 62P and positive switched contact 63) such that when the dome is depressed, it snaps downward to electrically bridge the two conductors. The accessory positive switched contact 63 and the accessory common negative buss contact pad 62N are both implemented using the Low Reflectivity Contact described below.

FIG. 6C illustrates an exploded view of the power distribution Printed Circuit Board assembly where a non-conductive layer 61 prevents the metal weapon Rail from electrically shorting the power distribution Printed Circuit Board 62. Spacer layer 63 is a non-conductive element which holds the snap dome switches in place so they do not move laterally during assembly. Metallic snap dome switches 64 provide the electrical switching action to mounted rail accessories. Top cover layer 65 provides environmental protection to the Printed Circuit Board 62 and the metallic snap dome switches 64 when the aforementioned layers are assembled.

Powered Accessory Mounting

FIGS. 8A-8C are illustrations of the typical mechanical interconnection and electrical interconnection of a power-consuming accessory (such as flashlight 8) to the Handguard 23 and Powered Rail 24. The perspective view of FIG. 8A shows how the Powered Accessory Mounting ACC attaches the power-consuming accessory to the Powered Rail 24 and consists of a rail grabber 301, spring contacts 302, spring plungers 303, and face seals 304. The spring plungers 303 depress the snap-dome switches on the Powered Rail 24, the spring contacts 302 provide electrical contact with the fixed electrical bus contacts 202 on the Powered Rail 24 Printed Circuit Board assembly, and the face seals 304 provide environmental protection.

FIGS. 8B and 8C are cutaway end views of the interconnection of a power-consuming accessory to the Handguard 23 and Powered Rail 24. In particular, the power-consuming accessory and associated Powered Accessory Mounting ACC are mechanically attached to the Handguard 23 in well-known fashion (via screw clamp SC shown here). The Powered Accessory Mounting ACC includes a pair of spring contact pins 82A, 82B which contact corresponding Low Reflectivity Contacts 62N and 62P which are mounted on Printed Circuit Board 60-3. Similarly, the Powered Accessory Mounting ACC includes a spring plunger 83 which contacts corresponding metallic snap dome switch 64 which is mounted on Printed Circuit Board 60-3.

Characteristics of Electrical Contacts and Connectors

An ideal electrical connector has a low contact resistance and high insulation value. It is resistant to vibration, water, oil, and pressure. It is easily mated/unmated, unambiguously preserves the orientation of connected circuits, reliable, and carries one or multiple circuits. Desirable properties for a connector also include easy identification, compact size, rugged construction, durability (capable of many connect/disconnect cycles), rapid assembly, simple tooling, and low cost. No single electrical connector has all of the ideal properties. The proliferation of types of electrical connectors is a reflection of the differing importance placed on the design factors.

From a light reflectivity standpoint, the selection of low resistivity metals to construct the contact contradicts with the goal of achieving low light reflectivity. In particular, gold is highly conductive and makes an excellent choice for a contact, but has a high light reflectivity. If coatings are applied to a gold contact to reduce the light reflectivity, the resistivity of the contact is increased and the coatings quickly wear off in a hostile ambient environment where there are many connect/disconnect cycles. Mechanically modifying the surface of the gold to reduce the flat light reflecting plane presented to incoming visible light also reduces the conductivity of the contact and fails to achieve adequate reductions in light reflectivity reduction. Similar problems are encountered with attempts to alloy gold with other metals.

Therefore, existing methods of modifying highly conductive metal contacts to reduce light reflectivity are ineffective.

Characteristics of the Low Reflectivity Contact

Figure 10:
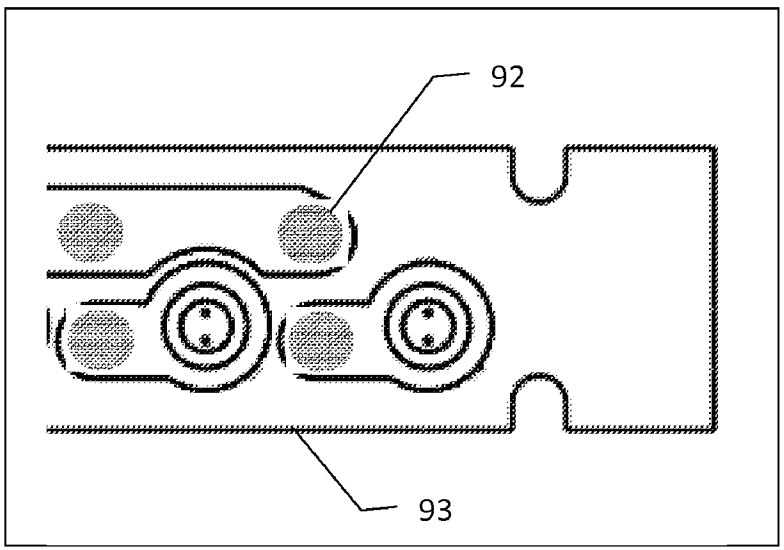
FIG. 10 is an illustration of a Low Reflectivity Contact soldered to a Printed Circuit Board.
Figure 9:
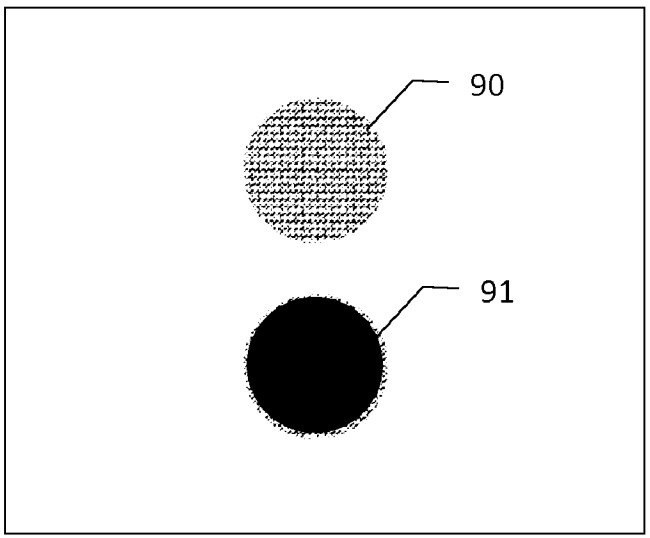
FIG. 9 is a schematic of loose mesh grid disks, plain side up and solder side up, which are used to implement the Low Reflectivity Contact.

FIG. 9 is a schematic of loose mesh contact disks, plain side 90 up and solder side 91 up, which are used to implement the Low Reflectivity Contact; and FIG. 10 is an illustration of a Low Reflectivity Contact 92 soldered to a Printed Circuit Board 93. The Low Reflectivity Contact 92 consists of one Contact of a Contact Pair and is manufactured from a suitable material, with one example being a 400 mesh, alloy 304 Stainless Steel which is woven with a 0.001" thick wire of cylindrical cross-section. The mesh is cut into the desired shape, such as a circle, and one side of the mesh is tinned with solder and soldered on to a Printed Circuit Board (PCB) which is designed to carry power from a power source to the electrical contacts. The other Contact of the Contact Pair consists of a spring loaded contact pin (or lever or any other mechanism to make mechanical contact with the Low Reflectivity Contact) to touch the mesh surface of the Low Reflectivity Contact to provide an electrical connection.

The selection of a wire mesh to implement the electrical contacts is dictated by the need to provide a low light reflectivity characteristic for the exposed electrical contacts. The need for low light reflectivity is important in certain applications, such as military weapons. In addition, the Low Reflectivity Contact provides a target of dimensions which enable the mating Contact of the Contact Pair to complete the circuit connection without the need for precise spatial three-dimensional alignments of the two Contacts of the Contact Pair.

Figure 11B:
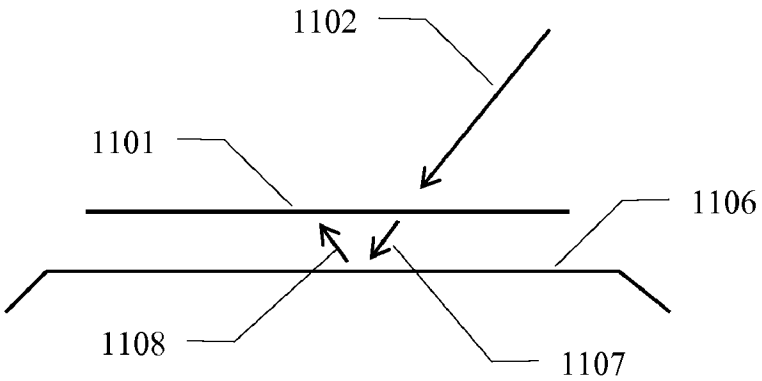
FIGS. 11A and 11B are illustrations of the light reflectivity geometry of the Low Reflectivity Contact.
Figure 11A:
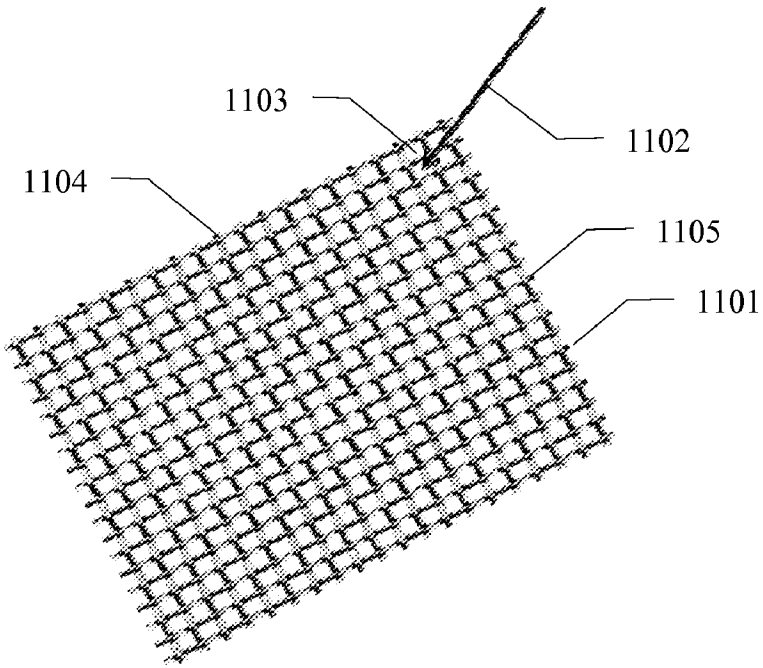

FIGS. 11A and 11B are illustrations of the light reflectivity geometry of the Low Reflectivity Contact. The Low Reflectivity Contact typically comprises a mesh grid 1101 formed of a matrix of electrical wires 1104 and 1105 which are interconnected to form a matrix with apertures 1103 formed in the surface thereof. Alternatively, the mesh grid 1101 can be formed of a sheet of electrically conductive material with apertures 1103 formed in the surface thereof. Incident visible light 1102 (as well as other wavelengths of light) is dispersed by the electric wires 1104, 1105; and only a small fraction of the incident visible light passes through the apertures 1103 of the mesh grid 1101 to the underlying surface 1106, which is typically a conductive pad on the surface of the Printed Circuit Board. The incident light 1107 that passes through the apertures 1103 is reflected 1108 off surface 1106 and strikes the bottom surface of the mesh grid 1101. Therefore, the only way the incident visible light is retransmitted back out of the Low Reflectivity Contacts is for the reflected beam 1108 to pass through an aperture 1103. Thus, by the proper selection of the size of the electric wires 1104, 1105, the density of the wires in the matrix, and the spacing between the mesh grid 1101 and the underlying surface 1106, the size of the apertures and the light reflection path can be managed to substantially eliminate the reflection of visible light off the Low Reflectivity Contact.

Thus, the present Low Reflectivity Contact minimizes light reflectivity by the use of a conductive mesh grid which is attached to an underlying conductive surface. The conductive mesh grid comprises a substantially planar structure, typically a matrix of interconnected wires with apertures formed between the intersecting wires, and is used to form the outer surface of the electrical contact. The weave density, weave geometry, and wire diameter of the conductive mesh grid maximizes the attenuation of reflected light in the visible spectrum, yet maintains high electrical conductivity and a lack of sensitivity to contamination via the choice of materials used to implement the Low Reflectivity Contact.

There has been described a Low Reflectivity Contact. It should be understood that the particular embodiments shown in the drawings and described within this specification are for purposes of example and should not be construed to limit the invention, which is described in the claims below. Further, it is evident that those skilled in the art may make numerous uses and modifications of the specific embodiment described without departing from the inventive concepts. Equivalent structures and processes may be substituted for the various structures and processes described; the subprocesses of the inventive method may, in some instances, be performed in a different order; or a variety of different materials and elements may be used. Consequently, the invention is to be construed as embracing each and every novel feature and novel combination of features present in and/or possessed by the apparatus and methods described.

It should also be noted that ratios, concentrations, amounts, and other numerical data may be expressed herein in a range format. It is to be understood that such a range format is used for convenience and brevity; thus, it should be interpreted in a flexible manner to include not only the numerical values explicitly recited as the limits of the range but also to include all of the individual numerical values or sub-ranges encompassed within that range as if each numerical value and sub-range is explicitly recited.

What is claimed as new and desired to be protected by Letters Patent of the United States is:

1. A Low Reflectivity Contact that provides minimal reflection of incident visible light, for use with a handguard which mechanically supports one or more power-consuming accessories, which are powered by a power source for providing a supply of electrical power for use by said one or more power-consuming accessories, comprising:

a powered rail, attached to a handguard and electrically interconnected with a power source, for providing a source of electrical power to one or more power-consuming accessories attached to said handguard; and wherein said powered rail comprises an insulative backplane which has formed thereon at least one Low Reflectivity Contact for presenting a point of connection to said power source for said one or more power-consuming accessories, said Low Reflectivity Contact comprising:

a mesh grid attached to said backplane and electrically connected to said power source for contacting a corresponding conductive element on said at least one power-consuming accessory for enabling conduction of at least one of power and electrical signals therebetween a conductive pad attached to said backplane and electrically connected to said power source, and wherein said mesh grid is overlaid over said conductive pad and constructed of a conductive material containing a plurality of apertures formed in the surface thereof for electrically contacting said conductive element on said power-consuming accessory and which enables incident light to pass through said planar surface substantially absent reflection off said conductive surface and back out through said apertures.

2. The Low Reflectivity Contact of claim 1 wherein said mesh grid comprises:

a planar surface, constructed of a conductive material and containing a plurality of apertures formed in the surface thereof.

3. The Low Reflectivity Contact of claim 1 wherein said mesh grid comprises:

a matrix of electrical wires interconnected to form a planar surface, said matrix containing a plurality of apertures formed in the surface thereof.

4. The Low Reflectivity Contact of claim 3 wherein said matrix of electrical wires comprise a plurality of wires of diameter and surface reflectivity characteristics to minimize reflection of incident visible light.

5. The Low Reflectivity Contact of claim 1 wherein said powered rail is connected to said handguard in a manner to expose said at least one Low Reflectivity Contact to said at least one power-consuming accessory via one or more apertures formed in said handguard.

6. The Low Reflectivity Contact of claim 1 wherein said powered rail is connected to said handguard to provide simultaneous mechanical attachment of said power-consuming accessory to said handguard and electrical connection of said power-consuming accessory to said powered rail.

7. The Low Reflectivity Contact of claim 1 wherein said powered rail further comprises:

power switch, juxtaposed to and associated with at least one Low Reflectivity Contact formed on said powered rail, activated by attachment of a power-consuming accessory to said handguard and said associated Low Reflectivity Contact for electrically interconnecting said associated Low Reflectivity Contact with said power source.

8. The Low Reflectivity Contact of claim 7 wherein said power switch comprises:

a pair of electrical contacts configured in a normally open circuit configuration, with one of said pair of electrical contacts being electrically connected to said power sources and another of said pair of electrical contacts being electrically connected to said Low Reflectivity Contact; and a depressable outer surface for enclosing said pair of electrical contacts and responsive to contact with a projection formed on an outer surface of said power-consuming accessory for displacing one of said pair of electrical contacts to electrically interconnect with another of said pair of electrical contacts.

9. The Low Reflectivity Contact of claim 1 wherein said handguard is a multifaceted structure, and one of a plurality of said powered rails is mounted in each of said facets of said handguard.

10. The Low Reflectivity Contact of claim 1 wherein said powered rail is mounted on said handguard, substantially coextensive along a length dimension of said handguard, said backplane comprises:

a plurality of Low Reflectivity Contacts formed on an exposed surface thereof in a spaced apart manner along said length dimension.

11. The Low Reflectivity Contact of claim 10 wherein said powered rail further comprises:

a plurality of power switches, each juxtaposed to and associated with a corresponding one of said plurality of Low Reflectivity Contacts formed on said powered rail, activated by attachment of a power-consuming accessory to said handguard and said associated Low Reflectivity Contact for electrically interconnecting said associated Low Reflectivity Contact with said power source.

12. The Low Reflectivity Contact of claim 1 wherein said powered rail is mounted on said handguard, substantially coextensive along a length dimension of said handguard, said backplane comprises:

a plurality of pairs of Low Reflectivity Contacts formed on an exposed surface thereof in a spaced apart manner along said length dimension, each one of said pair of Low Reflectively Contacts being connected to one of two electrical terminals of said power source.

13. The Low Reflectivity Contact of claim 12 wherein said powered rail further comprises:

a plurality of power switches, each juxtaposed to and associated with a corresponding one of said pairs of Low Reflectivity Contacts formed on said powered rail, activated by attachment of a power-consuming accessory to said handguard and said associated Low Reflectivity Contact for electrically interconnecting at least one of said associated pair of Low Reflectivity Contact with said power source.

14. A Low Reflectivity Contact for providing a supply of electrical power for use by one or more power-consuming accessories which are powered by a power source, comprising:

an insulative backplane which has formed thereon at least one Low Reflectivity Contact for presenting a point of connection to a power source for one or more power-consuming accessories, said Low Reflectivity Contact comprising:

a mesh grid, attached to said backplane and electrically connected to said power source for contacting a corresponding conductive element on said at least one power-consuming accessory for enabling conduction of at least one of power and electrical signals therebetween, constructed of a conductive material and containing a plurality of apertures formed in the surface thereof, which electrically contacts said conductive element on said power-consuming accessory and which enables a portion of incident light to pass through said apertures in said planar surface substantially absent reflection off said backplane and back out through said apertures, a conductive pad attached to said backplane and electrically connected to said power source, and wherein said mesh grid is overlaid over said conductive pad and constructed of a conductive material containing a plurality of apertures formed in the surface thereof for electrically contacting said conductive element on said power-consuming accessory and which enables incident light to pass through said planar surface substantially absent reflection off said conductive surface and back out through said apertures.

15. The Low Reflectivity Contact of claim 14 wherein said mesh grid comprises:

a matrix of electrical wires interconnected to form a planar surface, said matrix containing a plurality of apertures formed in the surface thereof.

16. The Low Reflectivity Contact of claim 15 wherein said matrix of electrical wires comprise a plurality of wires of diameter and surface reflectivity characteristics to minimize reflection of incident visible light.

17. The Low Reflectivity Contact of claim 14 wherein said mesh grid comprises:

a planar surface, constructed of a conductive material and containing a plurality of apertures formed in the surface thereof.

* * * * *